US005722569A

United States Patent [19]

Foster

[11] Patent Number: 5,722,569

[45] Date of Patent: Mar. 3, 1998

[54] TRIGGER SPRAYER WITH DISCHARGE PORT BLOCKING MECHANISM

[75] Inventor: Donald D. Foster, St. Charles, Mo.

[73] Assignee: Contico International, Inc., St. Louis, Mo.

[21] Appl. No.: 685,446

[22] Filed: Jul. 19, 1996

[51] Int. Cl.[6] ..... B67D 5/32

[52] U.S. Cl. ..... 222/153.13; 222/383.1; 239/333

[58] Field of Search ..... 222/153.13, 153.14, 222/341, 383.1; 239/333

[56] References Cited

U.S. PATENT DOCUMENTS

| | | | |
|---|---|---|---|
| 4,153,203 | 5/1979 | Tada | 239/333 |
| 4,606,480 | 8/1986 | Rodriguez Gazulla | 222/341 |
| 4,815,663 | 3/1989 | Tada | 222/383.1 X |
| 4,917,303 | 4/1990 | Maas et al. | 239/333 |
| 5,156,304 | 10/1992 | Battegazzore | 222/341 |
| 5,158,233 | 10/1992 | Foster et al. | 239/333 |
| 5,211,315 | 5/1993 | Geier | 222/383 |
| 5,228,602 | 7/1993 | Maas et al. | 222/340 |
| 5,332,128 | 7/1994 | Mass et al. | 222/383 |
| 5,564,604 | 10/1996 | Tada | 222/153.14 |
| 5,657,907 | 8/1997 | Dobbs et al. | 222/383.1 X |

*Primary Examiner*—Joseph Kaufman

*Attorney, Agent, or Firm*—Howell & Haferkamp, L.C.

[57] ABSTRACT

A trigger sprayer comprises a dispenser body, a pump mechanism adjacent the dispenser body, a trigger adjacent the pump mechanism, and a plug. The dispenser body has an intake port adapted for fluid communication with a source of liquid, an intake liquid flow path providing fluid communication between the intake port and the pump mechanism, a discharge port, and a discharge liquid flow path providing fluid communication between the pump mechanism and discharge port. The pump mechanism includes a pump element reciprocally moveable relative to the dispenser body to draw fluid in through the intake port and force it out through the discharge port. The trigger is moveable relative to the dispenser body between forward and rearward positions and is located and configured to cause the pump element to move from its first position to its second position when the trigger is moved from its forward position to its rearward position. The plug is connected to the trigger and moveable relative to the dispenser body between a blocking position in which it covers the discharge port and an unblocking position in which it is laterally spaced from the discharge port to avoid interference with the discharge of fluid through the discharge port. The trigger and plug are configured so that movement of the trigger between its forward and rearward positions causes movement of the plug between its blocking and unblocking positions.

21 Claims, 3 Drawing Sheets

TRIGGER SPRAYER WITH DISCHARGE PORT BLOCKING MECHANISM

BACKGROUND OF THE INVENTION

This invention relates to manually-operated reciprocating fluid pumps such as pump-type trigger sprayers.

A trigger sprayer typically includes a dispenser body, a closure cap connected to the dispenser body for securing the trigger sprayer to the neck of a container (or bottle), and a dip tube depending from the dispenser body and configured for extending through a mouth (i.e., opening) in the neck of the bottle.

The dispenser body has a manually operated pump which draws liquid up the dip tube from the bottle into the pump and dispenses it along a discharge liquid flow path in the dispenser body and out a discharge port of a discharge nozzle. A priming check valve upstream of the pump permits fluid flow from the container to the pump, but checks fluid flow from the pump back to the container. Another check valve within the discharge liquid flow path and downstream of the pump permits liquid flow from the pump to the nozzle, but checks liquid flow from the nozzle to the pump.

Some liquids are formulated to foam when the liquid comes into contact with air. Conventional trigger sprayers are not suitable to dispense these types of liquids because air seeps into the discharge liquid flow path via the discharge port of the discharge nozzle. This air causes the liquid in the discharge liquid flow path to prematurely foam and thereby interfere with the discharge of the liquid.

SUMMARY OF THE INVENTION

Among the several objects of the present invention may be noted the provision of an improved trigger sprayer for dispensing a fluid product; the provision of such a trigger sprayer configured for keeping air away from the product until the product is dispensed from the trigger sprayer; the provision of such a trigger sprayer configured for sealingly closing a discharge port of the trigger sprayer when its trigger is in a released position; the provision of such a trigger sprayer configured for the unimpeded discharge of product when the trigger is actuated to reciprocate a pump of the trigger sprayer; the provision of such a trigger sprayer configured for preventing unintentional discharge of liquid during shipment or storage of the trigger sprayer; the provision of such a trigger sprayer configured for preventing unintentional movement of its trigger during shipment or storage of the trigger sprayer; and the provision of such a fluid pump which is of relatively simple construction.

Generally, a trigger sprayer of the present invention comprises a dispenser body, a pump mechanism adjacent the dispenser body, a trigger adjacent the pump mechanism, and a plug. The dispenser body has an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, and a discharge liquid flow path providing fluid communication between the pump mechanism and discharge port. The pump mechanism includes a pump element reciprocally moveable relative to the dispenser body between first and second positions to draw fluid in through the intake port and force it out through the discharge port. The trigger is moveable relative to the dispenser body between forward and rearward positions and is located and configured to cause the pump element to move from its first position to its second position when the trigger is moved from its forward position to its rearward position. The plug is connected to the trigger and moveable relative to the dispenser body between a blocking position in which it covers the discharge port and an unblocking position in which it is laterally spaced from the discharge port to avoid interference with the discharge of fluid through the discharge port. The trigger and plug are configured so that movement of the trigger between its forward and rearward positions causes movement of the plug between its blocking and unblocking positions.

In another aspect of the present invention, a trigger sprayer comprises a dispenser body, a pump mechanism adjacent the dispenser body, a trigger mechanism adjacent the pump mechanism, and a locking member. The pump mechanism including a pump element reciprocally moveable relative to the dispenser body between first and second positions to draw fluid in through an intake port of the pump body and force it out through a discharge port of the pump body. The trigger mechanism includes a trigger moveable relative to the dispenser body between forward and rearward positions. The trigger is located and configured to cause the pump element to move from its first position to its second position when the trigger is moved from its forward position to its rearward position. The locking member is releasably engageable with both the trigger mechanism and the dispenser body for releasably locking the trigger in its forward position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
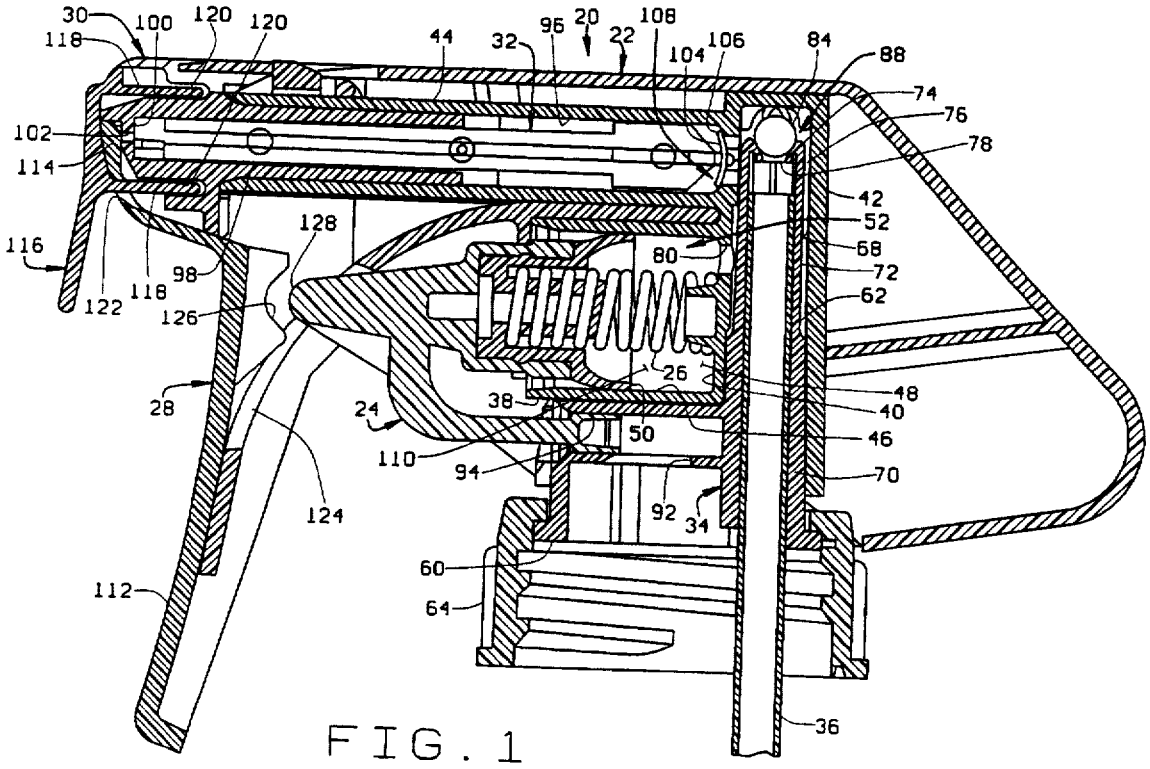
FIG. 1 is a fragmented side elevational view, in section, of a trigger sprayer of the present invention with a locking member locking a trigger of the sprayer in a forward position.

Referring now to the drawings, and first more particularly to FIG. 1, a trigger sprayer of the present invention is indicated in its entirety by the reference numeral 20. Preferably, the trigger sprayer 20 includes: (1) an upper housing member, generally indicated at 22; (2) a plunger, generally indicated at 24; (3) a coil spring 26; (4) a trigger mechanism 28; (5) a nozzle assembly, generally indicated at 30; (6) a spinner assembly, generally indicated at 32; (7) a lower housing member, generally indicated at 34; and (8) a dip tube 36. The upper housing member 22, lower housing member 34, nozzle assembly 30, and plunger 24 constitute a dispenser body.

The upper housing member 22 is preferably a single unitary piece and includes a cylindric wall 38, a circular back wall 40 substantially closing one end (i.e., the right end as viewed in FIG. 1) of the cylindric wall, a generally cylindric vertical formation 42 adjacent the circular back wall, and a horizontal tubular portion 44 extending forward from the vertical formation. The cylindric wall 38 includes a generally cylindric inner surface 46. The cylindric inner surface 46 of the cylindric wall 38 and the circular back wall 40 define a pump chamber, generally indicated at 48 open at one end (i.e., its left end as viewed in FIG. 1) for slidably receiving a piston head 50 of the plunger 24. The pump chamber 48, piston head 50, and spring 26 constitute components of a pump mechanism, generally indicated at 52.

The lower housing member 34 is a molded, one piece member and includes an annular flange 60 and an upwardly extending tubular portion 62. Preferably a threaded collar (or closure cap 64) is retained on the lower housing member 34 via the annular flange 60 for receiving a threaded neck of a liquid bottle (not shown). The tubular portion 62 extends upwardly into a vertical bore 68 of the vertical formation 42 of the upper housing member 22. Preferably, the tubular portion 62 has a lower region 70, an intermediate region 72, and an upper region 74. The lower region 70 of the lower housing tubular portion 62 is sized for a snug fit in the vertical bore 68 of the vertical formation 42 to provide a fluid tight seal therebetween. The intermediate region 72 has an outer diameter which is less than the inner diameter of the housing vertical bore 68. The outer surface of the intermediate region 72 and the surface of the housing vertical bore 68 define an annular fluid passage therebetween. Preferably, the inside diameter of the lower and intermediate regions 70, 72 of the lower member tubular portion 62 are sized for a snug fit of the upper portion of the dip tube 36.

The upper region 74 of the lower member tubular portion 62 includes a check-valve seat 78. The check-valve seat 78 defines an intake port (also referred to by reference number 78) of the trigger sprayer 20. The intake port 78 is in fluid communication with liquid (not shown) contained in the bottle 60 via the dip tube 36.

The upper housing member 22 further includes a lateral opening 80 extending through its circular back wall 40. Preferably, the lateral opening 80 is aligned with the intermediate region 72 of the lower member tubular portion 62 for providing fluid communication between the pump chamber 48 and the annular fluid passage. The upper region 74 of the lower member tubular portion 62, the annular fluid passage, and the lateral opening 80 define an intake liquid flow path providing fluid communication between the intake port 78 and the pump mechanism 52.

The check-valve seat 78 is shaped and configured for receiving a ball 84. The check-valve seat 78 and ball 84 constitute a priming check valve 88 in the intake liquid flow path for permitting fluid flow from the intake port 78 to the pump mechanism 52 and for checking fluid flow from the pump mechanism to the intake port. The ball 84 constitutes a moveable valve member of the priming check valve 88.

The plunger 24 further includes a plug 94 integrally connected to and moveable with the piston head 50. The plug 94 is adapted for closing a bottle vent opening 92 through the lower housing member 34 when the trigger sprayer 20 is not in use, to prevent liquid from spilling out of the bottle via the opening.

The horizontal tubular portion 44 of the upper housing member 22 includes a horizontal bore 96 extending horizontally between a rear portion and a forward end (left end as viewed in FIG. 1) of the upper housing member. The nozzle assembly 30 includes a tubular projection 98 inserted into the horizontal bore 96 via the forward (downstream) end of the bore, a nozzle wall 100 at a forward end of the nozzle tubular projection, and a nozzle orifice 102 through the nozzle wall and in fluid communication with the interior of the bore. The annular fluid passage, the horizontal bore 96, and the interior of the nozzle tubular projection 98 constitute a discharge liquid flow path. The nozzle orifice 102 constitutes a discharge port (also referred to via reference numeral 102) of the discharge liquid flow path. Dispensed liquid flows from the pump chamber 48, through the lateral opening 80, upward through the annular fluid passage, forward through the horizontal bore 96, and then out through the discharge port 102.

The spinner assembly 32 is positioned in the upper housing member's horizontal bore 96 and is held in place by the nozzle tubular projection 98. The spinner assembly 32 includes a resilient disc 104 at its rearward end (right end as viewed in FIG. 1). The resilient disc 104 is engageable with an annular shoulder 106 formed in the upper housing member 22 at the rear end of the horizontal bore 96. The resilient disc 104 and the annular shoulder 106 constitute a discharge check valve, generally indicated at 108, in the discharge liquid flow path for permitting fluid flow from the pump mechanism 52 to the nozzle discharge port 102 and for checking fluid flow from the discharge port 102 to the pump mechanism. In particular, the resilient disc 104 of the spinner assembly 32 constitutes a moveable valve member of the discharge check valve 108 and the annular shoulder 106 of the upper housing member 22 constitutes a valve seat of the discharge check valve. The resilient disc 104 is moveable between a closed position and an open position. In its closed (or seated) position, the resilient disc 104 sealing engages the annular shoulder 106 all around the shoulder to prevent passage of liquid therethrough. In its open (unseated) position, at least a part of the resilient disc 104 flexes forwardly away from the annular shoulder 106 to thereby provide a gap between the resilient disc and the shoulder to allow liquid to flow therethrough.

Figure 2:
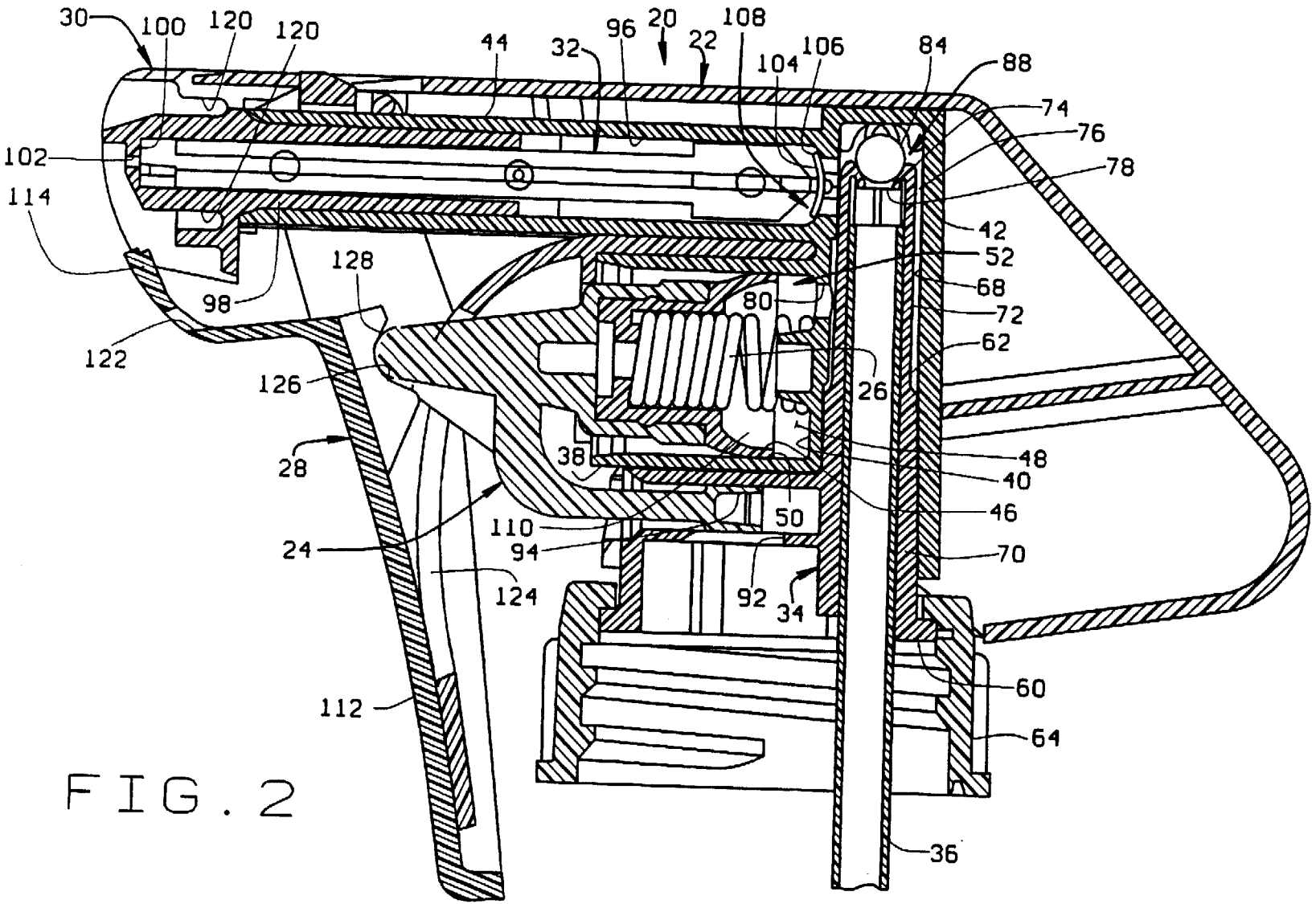
FIG. 2 is a fragmented side elevational view, in section, of the trigger sprayer of FIG. 1 with the locking member removed and with the trigger pivoted to a rearward position.

The piston head 50 of the plunger 24 is preferably formed of a suitable resilient material such as low density polyethylene. The piston head 50 comprises the rearward end (the right most end as viewed in FIG. 1) of the plunger 24. The piston head 50 is slidable within the pump chamber 48 and configured for sealing engagement with the cylindric inner surface 46 of the pump chamber 48 all around the piston head 50 to seal against leakage of fluid between the plunger 24 and cylindric inner surface 46 of the upper housing member 22. The piston head 50 and pump chamber 48 define a variable volume fluid receiving cavity 110. The piston head 50 is reciprocally slidable in the pump chamber 48 between a forward (extended) position (FIG. 1) and a rearward (compressed) position (FIG. 2). The plunger 24 is manually moved from its extended position to its compressed position by depressing the trigger mechanism 28. The coil spring 26 is positioned between the circular back wall 40 of the pump chamber 48 and the plunger 24 for urging the plunger forward to its extended position. Thus, the plunger 24 is rearwardly moved from its extended position to its compressed position by manually squeezing the trigger mechanism 28, and is automatically returned to its extended position via the piston spring 26 when the operator releases the trigger mechanism.

The trigger mechanism 28 is preferably a single monolithic piece and comprises a trigger 112 and a plug 114. The trigger 112 is pivotally connected to the dispenser body and is moveable between a forward position (FIG. 1) and a rearward or fully compressed position (FIG. 2). The plug 114 is moveable with the trigger 112 between a blocking position in which it covers the discharge port 102 and an unblocking (or uncovering) position in which it is laterally spaced from the discharge port to avoid interference with the discharge of fluid through the discharge port. The plug 114 is shaped and configured to seal closed the discharge port 102 when the plug is in its blocking position to seal against inadvertent leakage of ambient air (i.e., air outside of the trigger sprayer 20) into the discharge liquid flow path via the discharge port. When in its blocking position, the plug 114 also seals against inadvertent or premature discharge of liquid from the discharge port 102. A locking member 116 (FIG. 1) is releasably attachable to the nozzle assembly 30 for locking the plug 114 in its blocking position and for locking the trigger 112 in its forward position. The locking member 116 preferably includes two rearwardly extending tines 118 which are shaped and configured for releasable insertion into tine receiving sockets (or openings) 120 of the nozzle assembly 30. The plug 114 of the trigger mechanism 28 includes an opening 122 which is in alignment with one of the tine receiving sockets 120 of the nozzle assembly 30 when the plug is in its blocking position. With the plug 114 in its blocking position, the locking member 116 may be attached to the nozzle assembly 30 such that one of the tines 118 extends through the opening 122 of the plug 114 and into the aligned tine receiving socket 120. When the locking member 116 is so attached to the nozzle assembly 30, it interferes with movement of the plug 114 and trigger 112.

It is to be understood that the locking member 116 is to be disconnected and removed from the nozzle assembly 30 during operation of the trigger sprayer 20, i.e., when a user desires to dispense liquid. The locking member 116 is to be connected to the nozzle assembly 30 during shipment or storage of the trigger sprayer 20 to prevent unintended leakage of liquid out of discharge port and to prevent unintended leakage of air into the discharge liquid flow path.

The trigger sprayer 20 further includes a leaf spring 124 connected at one end to the upper housing member 22 and engageable at an opposite end with the trigger 112. The leaf spring 124 is configured and positioned for urging the trigger 112 to its forward position. The trigger 112 has a camming surface 126 engageable with a forward end 128 (i.e., the left most end as viewed in FIG. 1) of the plunger 24. Counterclockwise movement of the trigger 112 causes the camming surface 126 to push against the plunger 24 and thereby move the pump piston rearwardly (i.e., from left to right as viewed in FIG. 1). The coil spring 26 returns the plunger 24 to its forward/extended position when the trigger 112 is released. As shown in FIG. 1, the camming surface is spaced forward of the forward end 128 of the plunger 24 when the trigger 112 is in its forward position. FIG. 2 shows the trigger 112 pivoted rearwardly to an intermediate position in which the camming surface 126 engages the forward end 128 of the plunger 24 but does not cause substantial movement of the plunger and therefore does not result in the discharge of any liquid from the trigger sprayer 20. The trigger mechanism 28 is configured so that the plug 114 is spaced laterally from (i.e., not in the line of spray of) the discharge port 102 when the trigger 112 is in its intermediate position. Thus, movement of the trigger 112 from its forward position to its intermediate position moves the plug 114 from its blocking position to its unblocking position, but does not cause any movement of the plunger 24. Reciprocating movement of the trigger 112 between its intermediate and rearward positions causes movement of the plunger 24 between its extended and compressed positions, which causes liquid to be pumped out through the discharge port 102. The plug 114 remains out of the path of the spray stream when the trigger 112 is moved between its intermediate and rearward positions so that the plug does not interfere with the spraying operation of the trigger sprayer 20.

Figure 3:
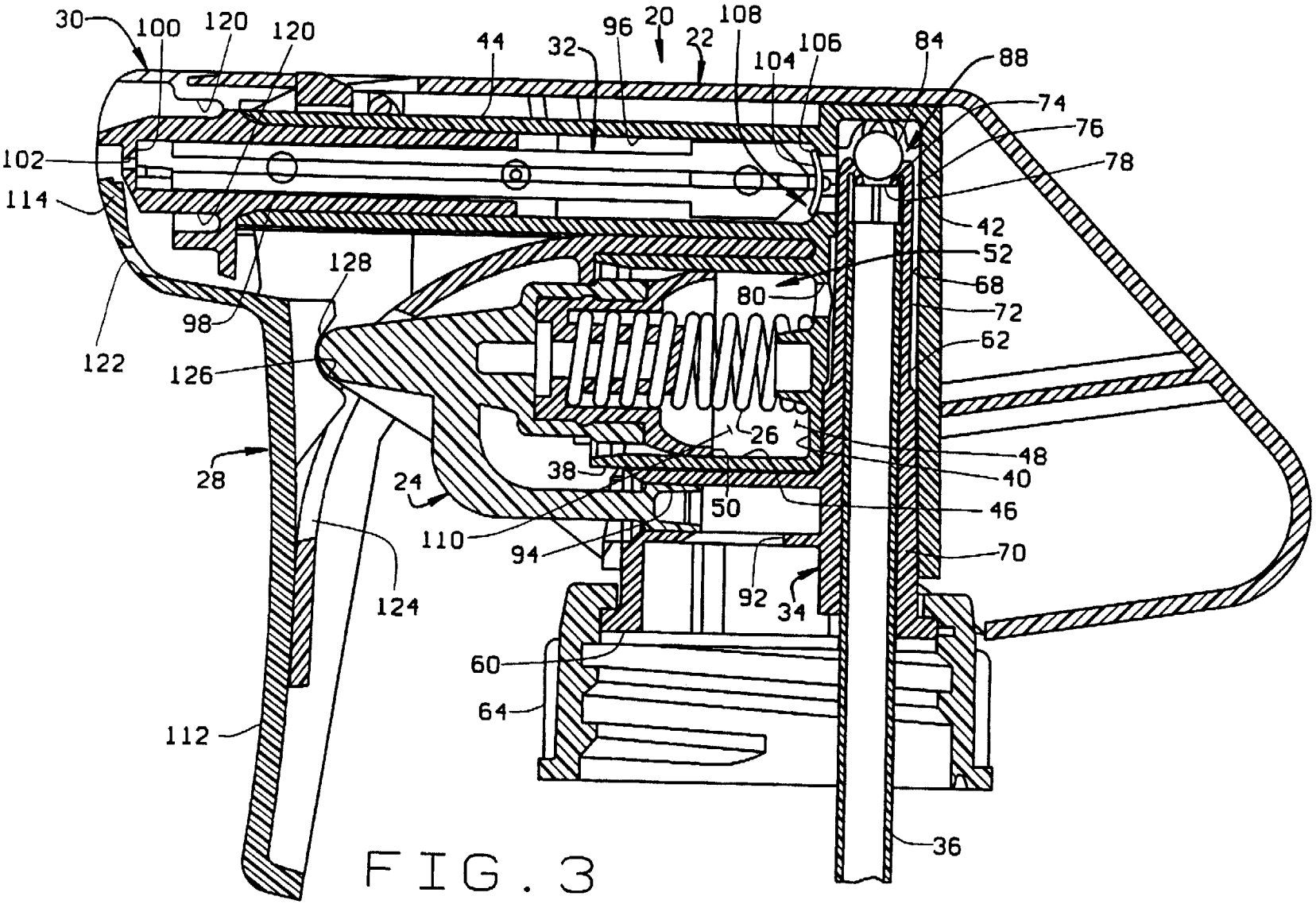
FIG. 3 is a fragmented side elevational view, in section, of the trigger sprayer of FIG. 1 with the trigger pivoted to an intermediate position.

In use, the user removes the locking member 116 and then pulls the trigger 112 against the force of the leaf spring 124 to move the trigger to its intermediate position where the plug 114 is out of alignment with the discharge port 102. The user further pulls the trigger 112 against both the force of the leaf spring 124 and the coil spring 26 causing the liquid to be dispensed through the discharge port 102. The trigger 112 is pulled in a continuous motion by the user from the forward position (FIG. 1) through the intermediate position (FIG. 3), to the rearward position (FIG. 3) so that the length of time that the discharge port 102 is uncovered before liquid is pumped through the discharge port is quite small, and therefore insufficient for any ambient air entering into the nozzle assembly 30 to cause product in the nozzle assembly to foam. When the trigger is released, the springs pivot the trigger 112 back to its forward position to block the discharge port 102.

Although spring 30 has been described as being a coil spring and spring 124 has been described as being a leaf spring, it is to be understood that the springs may be of other types without departing from the scope of this invention. For example, spring 30 could be replaced with a leaf spring and spring 124 could be replaced with a coil spring.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A trigger sprayer comprising:

a dispenser body;

a pump mechanism adjacent the dispenser body;

a trigger adjacent the pump mechanism; and a plug;

the dispenser body having an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, and a discharge liquid flow path providing fluid communication between the pump mechanism and discharge port;

the pump mechanism including a pump element reciprocally moveable relative to the dispenser body between first and second positions to draw fluid in through the intake port and force it out through the discharge port;

the trigger being moveable relative to the dispenser body between forward and rearward positions and being located and configured to cause the pump element to move from its first position to its second position when the trigger is moved from its forward position to its rearward position;

the plug being connected to the trigger and moveable relative to the dispenser body between a blocking position in which it covers the discharge port and an unblocking position in which it is laterally spaced from the discharge port to avoid interference with the discharge of fluid through the discharge port, the trigger and plug being configured so that movement of the trigger between its forward and rearward positions causes movement of the plug between its blocking and unblocking positions.

2. A trigger sprayer as set forth in claim 1 wherein the plug is shaped and configured to seal closed the discharge port when the plug is in its blocking position.

3. A trigger sprayer as set forth in claim 1 wherein the plug is shaped and configured to seal closed the discharge port and thereby seal against leakage of ambient air through the discharge port and into the discharge passageway when the plug is in its blocking position.

4. A trigger sprayer as set forth in claim 1 wherein the plug and trigger are of a single monolithic piece.

5. A trigger sprayer as set forth in claim 1 further comprising:

a first spring configured and located for urging the pump element to its first position; and a second spring configured and located for urging the trigger to its forward position.

6. A trigger sprayer as set forth in claim 5 wherein the trigger is moveable to an intermediate position between its forward and rearward positions, the trigger being configured to engage the pump element when the trigger is moved between its rearward and intermediate positions and configured to be spaced from the pump element when the trigger is moved between its intermediate and forward positions.

7. A trigger sprayer as set forth in claim 6 wherein the trigger and pump element are configured such that when the trigger is in its intermediate position and in engagement with the pump element, then the pump element is in its first position.

8. A trigger sprayer as set forth in claim 5 wherein the second spring engages the trigger.

9. A trigger sprayer as set forth in claim 1 wherein the trigger is moveable to an intermediate position between its forward and rearward positions, the trigger being configured to engage the pump element when the trigger is moved between its rearward and intermediate positions and configured to be spaced from the pump element when the trigger is moved between its intermediate and forward positions so that the trigger is moveable between its forward and intermediate positions without causing movement of the pump element.

10. A trigger sprayer as set forth in claim 1 further comprising a locking member releasably engageable with both the plug and the dispenser body for locking the plug in its blocking position.

11. A trigger sprayer as set forth in claim 10 wherein the dispenser body includes a first opening and wherein the plug includes a second opening which is in alignment with the first opening when the plug is in its blocking position, the locking member being configured to releasably extend into the aligned openings to prevent movement of the plug relative to the dispenser body.

12. A trigger sprayer as set forth in claim 1 wherein the plug and trigger are of a single monolithic piece, said trigger sprayer further comprising a locking member engageable with both the plug and the dispenser body for locking the plug in its blocking position and for locking the trigger in its forward position.

13. A trigger sprayer comprising:

a dispenser body;

a pump mechanism adjacent the dispenser body; and a trigger adjacent the pump mechanism;

the dispenser body having an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, and a discharge liquid flow path providing fluid communication between the pump mechanism and discharge port;

the pump mechanism including a pump element reciprocally moveable relative to the dispenser body between first and second positions to draw fluid in through the intake port and force it out through the discharge port;

the trigger being moveable relative to the dispenser body between a forward position and an intermediate position and between the intermediate position and a rearward position, the intermediate position being rearward of the forward position and forward of the rearward position, the trigger being located and configured to engage the pump element and cause the pump element to move from its first position to its second position when the trigger is moved from its intermediate position to its rearward position, the trigger being located and configured to be spaced from the pump element when the trigger is moved between its intermediate and forward positions so that the trigger is moveable between its forward and intermediate positions without causing movement of the pump element.

14. A trigger sprayer as set forth in claim 13 further comprising:

a first spring engageable with the pump element for urging the pump element to its first position; and a second spring engageable with the trigger for urging the trigger to its forward position.

15. A trigger sprayer as set forth in claim 13 further comprising a plug connected to and moveable with the trigger, the plug being configured to cover the discharge port when the trigger is in its forward position and to be laterally spaced from the discharge port when the trigger is in its intermediate position.

16. A trigger sprayer as set forth in claim 13 further comprising a plug connected to and moveable with the trigger, the plug being configured to cover the discharge port when the trigger is in its forward position and to be laterally spaced from the discharge port when the trigger is between its intermediate and rearward positions to avoid interference with the discharge of fluid through the discharge port.

17. A trigger sprayer as set forth in claim 16 wherein the plug and trigger are of a single monolithic piece.

18. A trigger sprayer as set forth in claim 16 wherein the plug is shaped and configured to seal closed the discharge port and thereby seal against leakage of ambient air through the discharge port and into the discharge passageway when the trigger is in its forward position.

19. A trigger sprayer comprising:

a dispenser body;

a pump mechanism adjacent the dispenser body;

a trigger mechanism adjacent the pump mechanism; and a locking member;

the dispenser body having an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge port, and a discharge liquid flow path providing fluid communication between the pump mechanism and discharge port;

the pump mechanism including a pump element reciprocally moveable relative to the dispenser body between first and second positions to draw fluid in through the intake port and force it out through the discharge port;

the trigger mechanism including a trigger moveable relative to the dispenser body between forward and rearward positions and being located and configured to cause the pump element to move from its first position to its second position when the trigger is moved from its forward position to its rearward position;

the locking member being releasably engageable with both the trigger mechanism and the dispenser body for releasably locking the trigger in its forward position.

20. A trigger sprayer as set forth in claim 19 wherein the trigger mechanism further comprises a plug moveable with the trigger, the plug being configured to cover the discharge port when the trigger is in its forward position and to be laterally spaced from the discharge port when the trigger is in its rearward position.

21. A trigger sprayer as set forth in claim 19 wherein the dispenser body includes a first opening and wherein the plug includes a second opening which is in alignment with the first opening when the trigger is in its forward position, the locking member being configured to releasably extend into the aligned openings to maintain alignment of the openings and thereby lock the rigger in its forward position.

* * * * *